United States Patent [19]

Schimmel

[11] 4,395,153

[45] Jul. 26, 1983

[54] FILE

[75] Inventor: Huibertus Schimmel, Alphen aan den Rijn, Netherlands

[73] Assignee: Samson Efficiency B.V., Alphen aan den Rijn, Netherlands

[21] Appl. No.: 306,630

[22] Filed: Sep. 28, 1981

[30] Foreign Application Priority Data

Aug. 14, 1981 [NL] Netherlands ..... 8103821

[51] Int. Cl.[3] ..... B42F 13/06

[52] U.S. Cl. ..... 402/15; 402/75

[58] Field of Search ..... 402/4, 8, 13, 15, 73, 402/75

[56] References Cited

U.S. PATENT DOCUMENTS

| | | | |
|---|---|---|---|
| 2,773,504 | 12/1956 | McGervey | 402/8 |
| 3,362,412 | 1/1968 | Moller | 402/15 |
| 4,229,022 | 10/1980 | Grundell | 281/45 |
| 4,256,411 | 3/1981 | Podosek | 402/73 |

FOREIGN PATENT DOCUMENTS

| | | |
|---|---|---|
| 1242184 | 6/1967 | Fed. Rep. of Germany . |
| 1290525 | 3/1969 | Fed. Rep. of Germany . |
| 2005106 | 8/1971 | Fed. Rep. of Germany . |
| 2714306 | 10/1978 | Fed. Rep. of Germany . |

*Primary Examiner*—Paul A. Bell

*Assistant Examiner*—John S. Brown

*Attorney, Agent, or Firm*—Beveridge, DeGrandi & Kline

[57] ABSTRACT

A file, consisting of a cover and at least two securing members, each securing member consisting of an oblong, narrow lacing portion, pointed at one end and connected at its other end to a foot portion which is short and wide with respect to the lacing portion; said cover being connected to a support sheet, wherein at least two inserting openings, which are wide with respect to the foot, and pertaining to each inserting opening, at least one protruding opening and one securing opening are provided; said protruding openings and securing openings being narrower than the foot of the securing member so that the securing member is insertable and lacable with its point through the inserting opening and subsequently through the protruding opening resulting in that the foot will be hooked on the support sheet at the protruding opening, whereas after possibly lacing the lacing portion through sheet material to be filed in the file, the point of the lacing portion is insertable through the securing opening; the distance between the inserting opening and the pertaining protruding opening is larger than the length of the foot portion, measured along the longitudinal axis of a securing member.

13 Claims, 6 Drawing Figures

FILE

Generally, the present invention relates to a file consisting of a cover and at least two securing members, each securing member being formed of an oblong, narrow lacing portion pointed at one end and connected at its other end to a foot portion which is wide with respect to the lacing portion; said cover for each securing member comprising a protruding opening and a securing opening which are narrower than the foot of the securing member so that the securing member is insertable and lacable with its point through the protruding opening, resulting in that the foot will be hooked to the file at the protruding opening whereas, after possibly lacing the lacing portion through sheet material to be filed in the file, the point of the lacing portion is insertable through the securing opening.

It is essential with such a file that each protruding opening is surrounded by as strong a part of the file as possible because the securing member in question is, for that matter, anchored to that part of the file with the contents of the file pending on said securing member. Such a strong fastening would be possible by arranging the protruding opening relatively far from the bottom edge and the top edge of the file but then the pages to be filed in the file should have perforations situated far from their bottom and top edges.

However, computers supply data on chain forms, that is long strips of paper which are perforated at their longitudinal edges and which should be folded zigzag transversely to their length. In order to be able to read such a strip folded zigzag into a pile of pages as if it is a book, one should be able to turn these pages as in a book, that is that each page should be arranged with its one edge formed by a zigzag folding line along the back of the file, so that only the perforations of the pages adjacent the ends of the back of the file can be used for fastening said strip on said file, as opposed to usual mutually apart pages which are provided with perforations near their back edge closer to their centre for mounting on the securing members with that perforated back edge adjacent the back of the file.

For this reason the invention provides a file consisting of a cover and at least two securing members, each securing member being formed of an oblong, narrow lacing portion pointed at one end and connected at its other end to a foot portion which is short and wide with respect to the lacing portion; said cover being connected to a support sheet, wherein at least two inserting openings, which are wide with respect to the foot, and pertaining to each inserting opening at least one protruding opening and a securing opening are provided; said protruding openings and securing openings being narrower than the foot of the securing member so that the securing member is insertable and lacable with its point through the inserting opening and subsequently through the protruding opening, resulting in that the foot will be hooked on the support sheet at the protruding opening whereas, after possibly lacing the lacing portion through sheet material to be filed in the file, the point of the lacing portion is insertable through the securing opening; the distance between the inserting opening and the pertaining protruding opening being larger than the length of the foot portion, measured along the longitudinal axis of a securing member.

Preferably the inserting opening is a straight cut in the support sheet of the above indicated file.

Because of the features indicated in the two above clauses, each protruding opening is surrounded by wide non-mutilated portions of the support sheet so that the possibility of tearing of the support sheet at the protruding opening is reduced.

In order to maximize this advantage, in a special embodiment of the invented file the distance between the inserting opening and the pertaining protruding opening is twice up to four times the length of the foot portion, measured along the longitudinal axis of a securing member.

In order to avoid fold lines in the support sheet in line with the inserting openings, said fold lines reducing the strength of the support sheet, it is preferred according to the present invention that each inserting opening is positioned obliquely relative to the back of the file and that none of the inserting openings are mutually in line.

The inserting openings should be wide so as to be able to let the wide foot of the securing member pass, whereas many inserting openings are necessary for the many protruding openings. In order to avoid that the support sheet is weakened by to much inserting openings, according to the invention two protruding openings and two securing openings pertain to each inserting opening.

Preferably, according to the invention, the support sheet is secured to the cover near the back section of the cover, which may for instance be done by means of staples.

Moreover, according to the invention, the support sheet may consist of the inwardly folded extension of the rear face of the cover, so that the support sheet is connected in a simple, cheap and yet strong way to the rear face of the file.

For reinforcement purposes it is possible according to the invention that between the rear face of the file and the support sheet formed by the extension of the rear face, a sheet of cardboard is provided.

In particular, according to the invention, both at the lower edge as well as at the upper edge of the support sheet at least one inserting opening with at least one pertaining set of a protruding opening and a securing opening are present, the distance between the protruding openings of each set of two cooperating protruding openings being equal to the distance between the series of perforations at both edges of a strip, as used in a computer for recording data from the computer.

The above embodiment of the invented file can be made also useful for filing ordinary sheets by at least two inserting openings with each at least one pertaining set of protruding and securing openings at locations positioned more to the center portion of the support sheet adjacent the back of the file, the distance between two protruding openings, each belonging to a different inserting opening, being a usual distance for the perforations for a file, for instance 80 mm.

Also the invented file may be provided with an almost completely cut out section of the support sheet, said section being provided with tongue forming notches, said tongues being insertable into cuts in the support sheet, said cuts being positioned in such a way that the section, then teared out of the support sheet and mounted by its inserted tongues, protrudes outside an edge of the rear sheet of the file in order to form an identifying tabs.

The invention will be further described and elucidated in the following description of a preferred embodiment of the invented file as illustrated schematically in the drawings.

Figure 1:
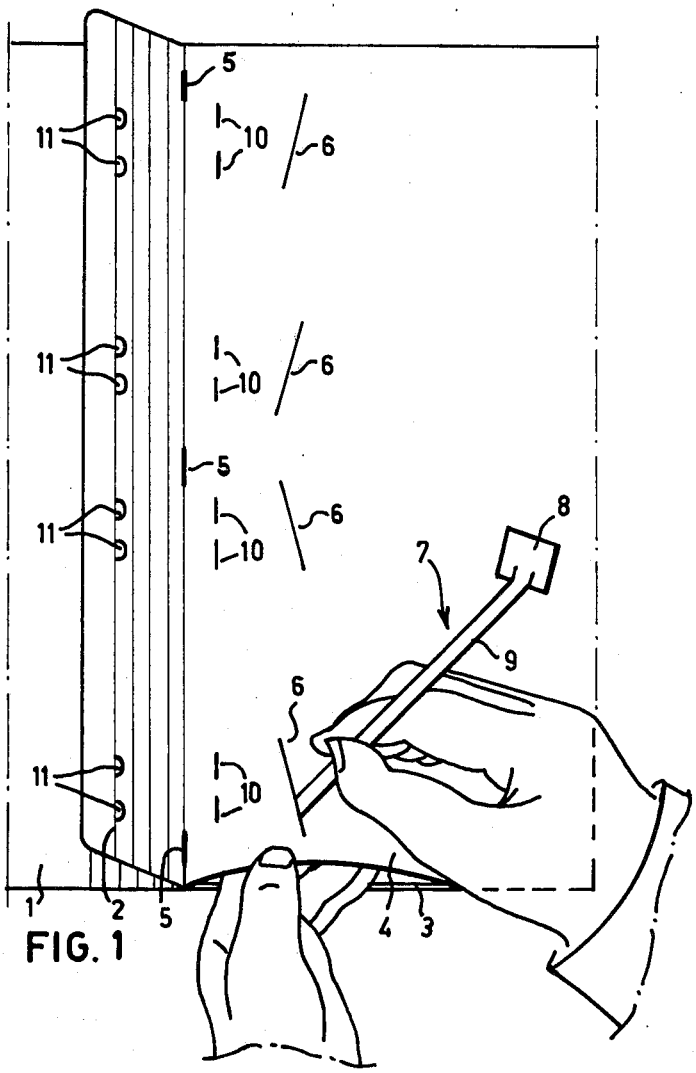
FIG. 1 shows how a securing member is inserted in an inserting opening in the file according to the invention.

According to FIG. 1 the preferred embodiment of the invented file consists of a cover provided with a leading face 1, a back 2 and a rear face 3, which form a unit together. Said unit can be made of, for instance a single sheet of resilient, tough file carboard with a weight of, for instance 300 grams per $m^2$, i.e. manilla cardboard.

At the back section 2 of the file a support sheet 4 is connected to the file, for instance by staples 5. The support sheet 4 is preferably the extension of the rear face 3 of the file, said extension being folded backwards so as to form the support sheet 4. It goes without saying that the support sheet is then made of the same material as the rest of the file. In the support sheet 4 inserting openings 6 are provided, which are preferably in the configuration of straight cuts, said cuts being preferably arranged obliquely relative to the back 2 of the file to prevent the support sheet from folding along said cuts, which could occur if the cuts would be mutually aligned. For such a fold weakens the support sheet 4, which could thereby tear along said fold at the ends of the cuts 6. Another advantage of the oblique arrangement of the inserting openings 6 will be elucidated later on.

Into each inserting opening 6 a securing member 7 according to FIG. 1 to insertable, said securing member consisting of a foot portion 8 and a lacing portion 9 which are formed as a single body out of flexible synthetic material, like for instance polypropylene. Said foot portion 8 can be formed square to the lacing portion 9 or the foot portion is bent into said position with respect to the lacing portion. The other end of the lacing portion 9, which is consequently not connected to the foot portion, terminates in a smooth point, so that said point is easily insertable into the openings.

Figure 2:
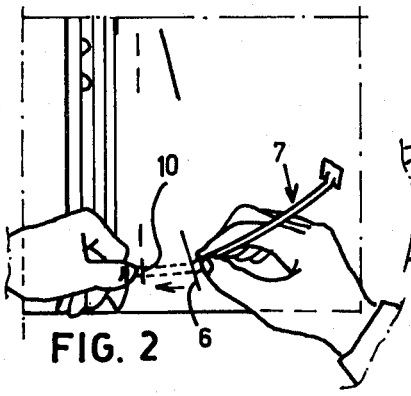
FIG. 2 shows how the securing member, after being inserted as according to FIG. 1, is laced through the protruding opening of the file according to FIG. 1.

After the securing member 7 is inserted with its point into an inserting opening 6, according to FIG. 2 said point is forced through an protruding opening 10 which, for instance in the configuration of a straight cut, is provided in the support sheet 4, and which pertains to the present inserting opening 6. Subsequently the securing member 7 is laced through the protruding opening 10, so that finally the foot 8 arrives at the inserting opening 6. Because of the oblique arrangement of the inserting opening 6 relative to the back of the file an angular portion of the square foot 8 will arrive first at the respective inserting opening 6 and thereby the foot will move more easily into the inserting opening via said angular portion which gradually widens to the full width of the foot, then in case the foot has to be inserted immediately along its full width into the inserting opening. The lacing of the lacing portion 9 through the protruding opening 10 is continued until the securing member will be hooked with its foot 8 behind the support sheet 4, according to FIG. 3. For that purpose the protruding opening 10 is smaller than the foot portion 8 of the securing member 7.

Figure 3:
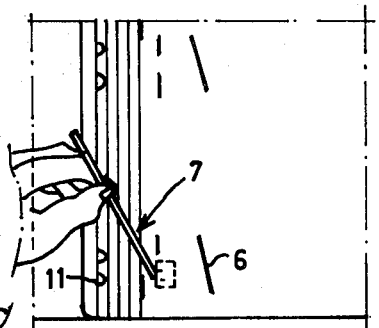
FIG. 3 shows the securing member anchored in the protruding opening, and now ready to be laced through sheets to be filed in the file, the operation according to this figure being subsequent to that of FIG. 2.

In order to fixedly anchor the securing member to the support sheet 4 in the relative position according to FIG. 3, the support sheet should be weakened as little as possible in the neighborhood of the protruding opening 10, and therefore the inserting opening 6 is positioned at a considerable distance from the pertaining protruding opening 10. The distance between the inserting opening 6 and the pertaining protruding opening 10 is for instance two up to four times the length of the foot portion 8, measured along the longitudinal axis of the securing member 7.

Subsequently the sheets to be filed in the file can be laced with their perforations or the lacing portion 9 of the securing member 7, after which the securing member can be inserted with its point into a securing opening 11, which is provided in the support sheet section which is located beyond the back 2 above the leading face 1 of the file, so that the sheets are now secured in the file via the securing member 7. Each securing opening 11 is preferably in the configuration of an arc-shaped cut so that a hole is created, which is closed by a tongue, into said hole the lacing portion 9 being insertable without the risk that said cut is torn easily.

In order to reinforce the file, a sheet of cardboard may be arranged between the support sheet 4 and the rear face 3, said sheet of cardboard being adapted to be introduced loosely, or may be secured onto the rear face 3. The leading face 1 of the file may also be reinforced at its interior for instance by adhering a sheet of cardboard thereto. For simplicity's sake said sheets of cardboard are not illustrated in the drawing off may for instance be made of grey cardboard with a thickness of 1 to $1\frac{1}{4}$ mm.

In practice the perforations of the sheets to be filed in the file are not always at the same distance. For instance a standard distance for perforations punched into sheets is 80 mm center to center. However, computers record data on chain forms, i.e. long strips of paper which are perforated at their longitudinal edges and which for filing have to be folded in zigzag manner transversely to their longitudinal axis. In order to to able to read such a zigzag folded strip, forming a pile of mutually connected sheets, like a book, i.e. that the sheets can be turned over as in a book, the sheets have to be arranged in such a way that their fold lines at one side are positioned along the back of the file, so that the perforations of the sheets are only present at the ends of the back of the file, contrary to the above mentioned punched, mutually loose sheets wherein the perforations are positioned more to the center of the back of the file, for instance 40 mm at both sides of the center of the back. Moreover the perforated longitudinal edges of said computer strips may also be at different distances from each other, considering that standard sized computer strips are known with widths of for instance approximately 360 mm or approximately 375 mm of even approximately 400 mm, whereas the distance between the series of perforations along both longitudinal edges of the strip is somewhat less than the indicated widths, as the perforations are positioned very closely to the longitudinal edges of the strip. In order to take care of slight differences in the position of the perforations, the length of the cut-like protruding opening 10 is for instance 7 mm in the event of a width of for instance 3 mm of the lacing portion 9.

In order to make one and the same file suitable for use for said widely varying standard distances between the perforations of sheets to be filed in said files, each support sheet 4 should be provided with many protruding openings 10, for instance as illustrated in FIG. 1, wherein of each pair of protruding openings, which is destined for sheets which are perforated according to a certain standard size, its openings are spaced at the same distance as the standard distance between the pertaining perforations in the sheets. It goes without saying that each protruding opening 10 should be accompanied by a pertaining securing opening 11 and a pertaining inserting opening 6. In order to restrict the number of inserting openings and thereby save expenses, for each set of adjacently arranged protruding openings 10 only a single, long inserting opening 6 as shown in FIG. 1 can be made in the support sheet 4. This can be done since the inserting openings 6 have no function in securing the position of the securing members 7. The protruding openings 10 and the securing openings 11 should secure the position of the securing members 7 and therefore they should be only a little wider than the width of the lacing portion 9 of the securing member 7 and the protruding openings 10 should be narrower than the foot 8 of the securing member to anchor same to the support sheet 4.

Figure 4:
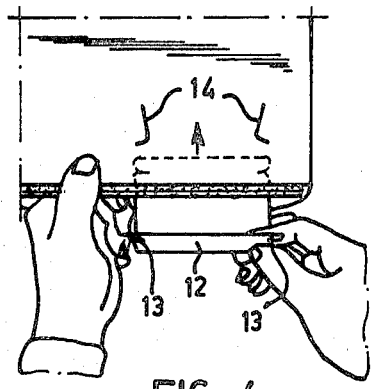
FIGS. 4, 5 and 6 show the provision of a tab on the file, the tab being destined to bear a title or identification for the file.
Figure 5:
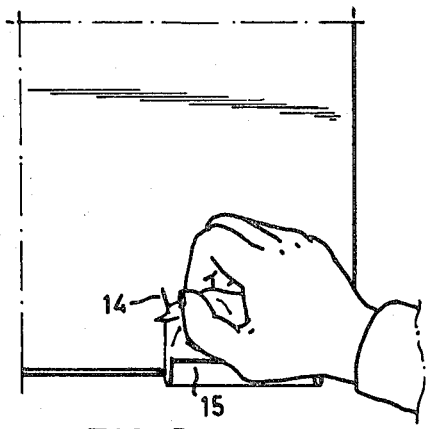
Figure 6:
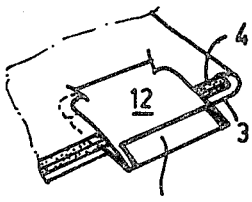

Preferably a central portion of the support sheet 4 is almost completely surrounded by punched cuts and the remaining narrow bridge-like portions between said central portion and the rest of the support sheet 4 can easily be torn in order to tear off the central portion from the support sheet. According to FIG. 4 said central portion 12 is provided with tongue-like portions 13 which, according to FIG. 5, are insertable into cuts 14 in the support sheet 4. Thus the central portion 12 can be folded into two identical halves to form a tab protruding beyond a side edge of the file. The tab may be provided with a heading or similar identification 15 according to FIG. 6 so as to identify the file between a series of similar files.

Summarizing it appears that the present invention provides a file, which can be manufactured cheaply and of cheap material, and that said file can be used for sheets with varying distances between the perforations in the sheets to be filed, said file being particularly useful for zigzag folded computer strips, portions of said strips being secured at the back of the file like sheets of a book, by means of the securing members 7, so that the portions of said strip can be turned over like sheets of a book, said portions being always in a completely flat position, and thus completely readable. Therefore the computer may uninterruptedly write on the complete strip because said strip can be filed in the file while remaining completely readable. This saves a lot of money because interrupting the process of a computer is very expensive. Because the invented film only needs a small space valuable storing space is saved as well.

I claim:

1. A file, comprising a cover and at least two securing members, each securing member being formed of an oblong, narrow lacing portion pointed at one end and connected at its other end to a foot portion which is short and wide with respect to the facing portion; said cover being connected to a support sheet wherein at least two inserting openings, which are wide with respect to the foot, and pertaining to each inserting opening, at least one protruding opening and one securing opening are provided, said protruding openings and said securing openings being narrower than the foot of the securing member so that the securing member is insertable and lacable with its point through the inserting opening and subsequently through the protruding opening, resulting in that the foot will be hooked on the support sheet at the protruding opening whereas, after possibly lacing the lacing portion through sheet material to be filed in the file, the point of the lacing portion is insertable through the securing opening; the distance between the inserting opening and the pertaining protruding opening being larger than the length of the foot portion, measured along the longitudinal axis of a securing member.

2. A file according to claim 1, characterized in that the inserting opening is a straight cut in the support sheet.

3. A file according to claim 1, characterized in that the distance between the inserting opening and the pertaining protruding opening is substantially within the range of two to four times the lenght of the foot portion, measured along the longitudinal axis of a securing member.

4. A file according to claim 2, characterized in that each inserting opening is positioned obliquely relative to the back of the file and that none of the inserting openings are mutually in line.

5. A file according to any of claims 1 to 4 characterized in that two protruding openings and two securing openings pertain to each inserting opening.

6. A file according to any of claims 1 to 4, characterized in that the support sheet is secured to the cover near the back section of the cover.

7. A file according to claim 6, characterized in that the support sheet is secured, by means of staples, to the cover at the back section of the cover.

8. A file according to any of claims 1 to 4, characterized in that the support sheet consists of the inwardly folded extension of the rear face of the cover.

9. A file according to claim 8, characterized in that between the rear face of the file and the support sheet formed by the extension of the rear face, a sheet of cardboard is provided.

10. A file according to any of claims 1 to 4, characterized in that both at the lower edge as well as at the upper edge of the support sheet at least one inserting opening with at least one pertaining set of a protruding opening and a securing opening are present, the distance between the protruding openings of each set of two cooperating protruding openings being equal to the distance between the series of perforations at both edges of a strip, as used in a computer for recording data from the computer.

11. A file according to claim 10, characterized in that moreover at least two inserting openings with each at least one pertaining set of protruding and securing openings are present at locations positioned more to the center portion of the support sheet adjacent the back of the file, the distance between two protruding openings, each belonging to a different inserting opening, being a usual distance for the perforations for a file.

12. A file according to any of claims 1 to 4, characterized by an almost completely cut out section of the support sheet, said section being provided with tongue-forming notches, said tongues being insertable into cuts in the support sheet, said cuts being positioned in such a way that the section, then teared out of the support sheet and mounted by its inserted tongues, protrudes outside an edge of the rear sheet of the file in order to form an identifying tab.

13. A file according to any of claims 1 to 4, characterized in that the securing opening is in the configuration of an arc-shaped cut.

* * * * *